US007654013B2

(12) United States Patent
Savoie et al.

(10) Patent No.: US 7,654,013 B2
(45) Date of Patent: Feb. 2, 2010

(54) REMOVABLE FOOTWEAR TRACTION PLATE

(75) Inventors: Armand J. Savoie, Gardner, MA (US); Wilson Yue, Hong Kong (HK)

(73) Assignee: Cleats LLC, Marlborough, MA (US)

( * ) Notice: Subject to any disclaimer, the term of this patent is extended or adjusted under 35 U.S.C. 154(b) by 552 days.

(21) Appl. No.: 11/179,034

(22) Filed: Jul. 11, 2005

(65) Prior Publication Data

US 2006/0090373 A1 May 4, 2006

Related U.S. Application Data

(60) Provisional application No. 60/587,158, filed on Jul. 12, 2004.

(51) Int. Cl.
*A43C 15/00* (2006.01)
*A43B 5/00* (2006.01)

(52) U.S. Cl. ..... 36/67 D; 36/134; 36/127

(58) Field of Classification Search ..... 36/67 D, 36/134, 127, 115, 67 A
See application file for complete search history.

(56) References Cited

U.S. PATENT DOCUMENTS

| | | | | | |
|---|---|---|---|---|---|
| 2,034,050 | A * | 3/1936 | Levy | ..... | 36/59 R |
| 4,782,604 | A * | 11/1988 | Wen-Shown | ..... | 36/127 |
| 5,533,282 | A * | 7/1996 | Kataoka et al. | ..... | 36/129 |
| 5,979,083 | A * | 11/1999 | Robinson et al. | ..... | 36/127 |
| 5,996,260 | A | 12/1999 | MacNeill | | |
| 6,154,984 | A | 12/2000 | Adam | | |
| 6,397,499 | B1 | 6/2002 | Savoie | | |
| 6,647,647 | B2 * | 11/2003 | Auger et al. | ..... | 36/134 |
| 6,722,061 | B2 * | 4/2004 | Auger et al. | ..... | 36/136 |
| 7,134,226 | B2 * | 11/2006 | Robinson et al. | ..... | 36/134 |
| 2002/0043008 | A1 * | 4/2002 | Favreau | ..... | 36/134 |
| 2003/0033735 | A1 * | 2/2003 | Ijiri | ..... | 36/134 |
| 2003/0074807 | A1 | 4/2003 | Sato et al. | | |
| 2005/0155256 | A1 | 7/2005 | Santos et al. | | |

FOREIGN PATENT DOCUMENTS

| | | |
|---|---|---|
| WO | WO 00/64294 | 11/2000 |

* cited by examiner

*Primary Examiner*—Jila M Mohandesi
(74) *Attorney, Agent, or Firm*—Sunstein Kann Murphy & Timbers LLP

(57) ABSTRACT

A traction plate for a shoe. The traction plate is removably attachable to the outsole of a shoe to provide traction on a surface for a shoe wearer. The plate includes a flange with one or more surface-engaging elements on one face. The plate also includes two or more shoe-coupling elements. The shoe-coupling elements are inserted into corresponding receptacles in a shoe-outsole and then rotated to affix the plate to the shoe. The shoe-coupling elements may be captively attached to the plate flange or attachable to the shoe receptacle with a rotation of no more than one full revolution.

9 Claims, 6 Drawing Sheets

REMOVABLE FOOTWEAR TRACTION PLATE

This application claims priority from U.S. provisional patent application No. 60/587,158, filed Jul. 12, 2004, entitled "Removable Footwear Traction Plate," which is incorporated herein by reference.

TECHNICAL FIELD

The present invention relates to traction gear mounted on the bottom of footwear, in particular, athletic footwear.

BACKGROUND

Conventional traction gear for footwear use a large number of individual traction elements, such as cleats, that are attached to the outsole of a shoe. The typical golf shoe, for example, includes seven cleats that are individually attached to the shoe by screwing the cleat into the mated receiving receptacle in the bottom of the footwear. Progress has been made in recent years in reducing the effort needed to attach and to remove traction elements from footwear by reducing the rotations needed to attach each traction element. For example, U.S. Pat. No. 5,768,809 describes a quick-release Q-LOK™ traction element connector. When inserted into a receptacle, a Q-LOK™ connector can be securely attached to an outsole by rotating the cleat approximately a third of a turn.

Such approaches to footwear traction do not provide for removable traction structures that are larger than can be secured to the shoe effectively by a single closure. Further, these approaches do not allow for an arbitrary rotational orientation of the traction element with respect to the shoe outsole.

SUMMARY OF THE INVENTION

In a variety of embodiments of the present invention, a traction plate is provided that is removably attachable to a shoe. The traction plate includes a flange with one or more attached traction elements, also known as surface-engaging elements, to provide traction for the shoe wearer on a surface. The plate also includes one or more shoe-coupling elements to attach the plate to a shoe. The shoe-coupling elements are inserted into corresponding receptacles in a shoe outsole and rotated to attach the plate to the shoe. To detach the plate from the shoe, the shoe-coupling elements are rotated in the opposite direction and then removed from the receptacles.

In one embodiment of the invention, a plurality of shoe-coupling elements for the plate are provided with at least one of the elements attachable to the corresponding receptacle in the shoe by a rotation of no more than 360 degrees. In other embodiments of the invention, at least one of the elements is attachable to the corresponding receptacle by rotation of not more than 270, 180, or 120 degrees respectively. In a further specific embodiment of the invention, the plate flange includes a weight-bearing portion remote from the flange edge, such that the weight-bearing portion bears a majority of the shoe wearer borne by the plate.

In another embodiment of the invention, a plurality of shoe-coupling elements for the plate are provided with at least one of the elements captively attached to the plate flange.

In another embodiment of the invention, a shoe-coupling element is provided that is removably attachable to the flange. The shoe-coupling element is attachable to the corresponding receptacle in the shoe by a rotation of no more than 360 degrees. In other embodiments of the invention, the element is attachable to the corresponding receptacle by rotation of not more than 270, 180, or 120 degrees respectively. This arrangement advantageously allows the traction plate and the shoe-coupling element to rotate independently so that a desired orientation of the traction plate with respect to the outsole may be achieved.

The surface-engaging elements of any of the preceding embodiments may be of any number, shape, composition, and orientation. Traction plates according to any of the preceding embodiments may be used in any combination on a shoe outsole. The traction plates may be combined with conventional cleats on a shoe outsole in any combination.

In another embodiment of the invention, a method is provided to replace cleats installed on a shoe outsole with traction plates. The method includes removing a plurality of cleats from corresponding receptacles in the outsole where the traction plate would cover the cleat, providing a traction plate with shoe-coupling elements positioned to match the plurality of corresponding receptacles, inserting the shoe-coupling elements into the corresponding receptacles and rotating the shoe-coupling elements to secure the traction plate to the shoe outsole.

BRIEF DESCRIPTION OF THE DRAWINGS

The foregoing features of the invention will be more readily understood by reference to the following detailed description, taken with reference to the accompanying drawings, in which.

DETAILED DESCRIPTION OF SPECIFIC EMBODIMENTS

Definitions. As used in this description and the accompanying claims, the following terms shall have the meanings indicated, unless the context otherwise requires:

A "shoe" means any outer covering for a foot including, without limitation, athletic footwear, sandals, boots, and slippers.

A "flange" means any generally planar object. A flange may be solid or web-like or any combination of portions that are solid or web-like. A flange comprises any planar geometry including concave portions or convex portions or combinations of concave and convex portions.

A "surface-engaging element" is any physical configuration that provides traction when contacting a surface. Surface-engaging elements may include, without limitation, any of the protrusions known in the art for that purpose including any of the protrusions or combinations of protrusions taught in U.S. Pat. Nos. D320882, D454248, D468895, D493276, 6,023,860, 6,041,526, 6,052,923, 6,327,797, 6,354,021, 6,463,682, 6,530,162, and 6,834,445, each of which is incorporated herein by reference. A surface-engaging element may be made of any suitable material such as, without limitation, plastic, metal, rubber, etc. Surface-engaging elements may also be made from more than one material or more than one species of a material and these elements may vary in color and hardness.

In a variety of embodiments of the present invention, a traction plate is provided that is removably attached to a shoe. The traction plate includes a flange with one or more surface-engaging elements to provide traction for a shoe wearer on a surface. The plate also includes one or more shoe-coupling elements that are inserted into corresponding receptacles in a shoe outsole and rotated to attach the plate to the shoe. In a specific embodiment of the invention, a plurality of shoe-coupling elements are provided for the plate with at least one shoe-coupling element attached to the outsole by insertion into a receptacle embedded in the outsole and rotation by no more than 360 degrees. In another embodiment of the invention, a plurality of shoe-coupling elements are provided for the plate with at least one shoe-coupling element captively attached to the flange.

Figure 1:
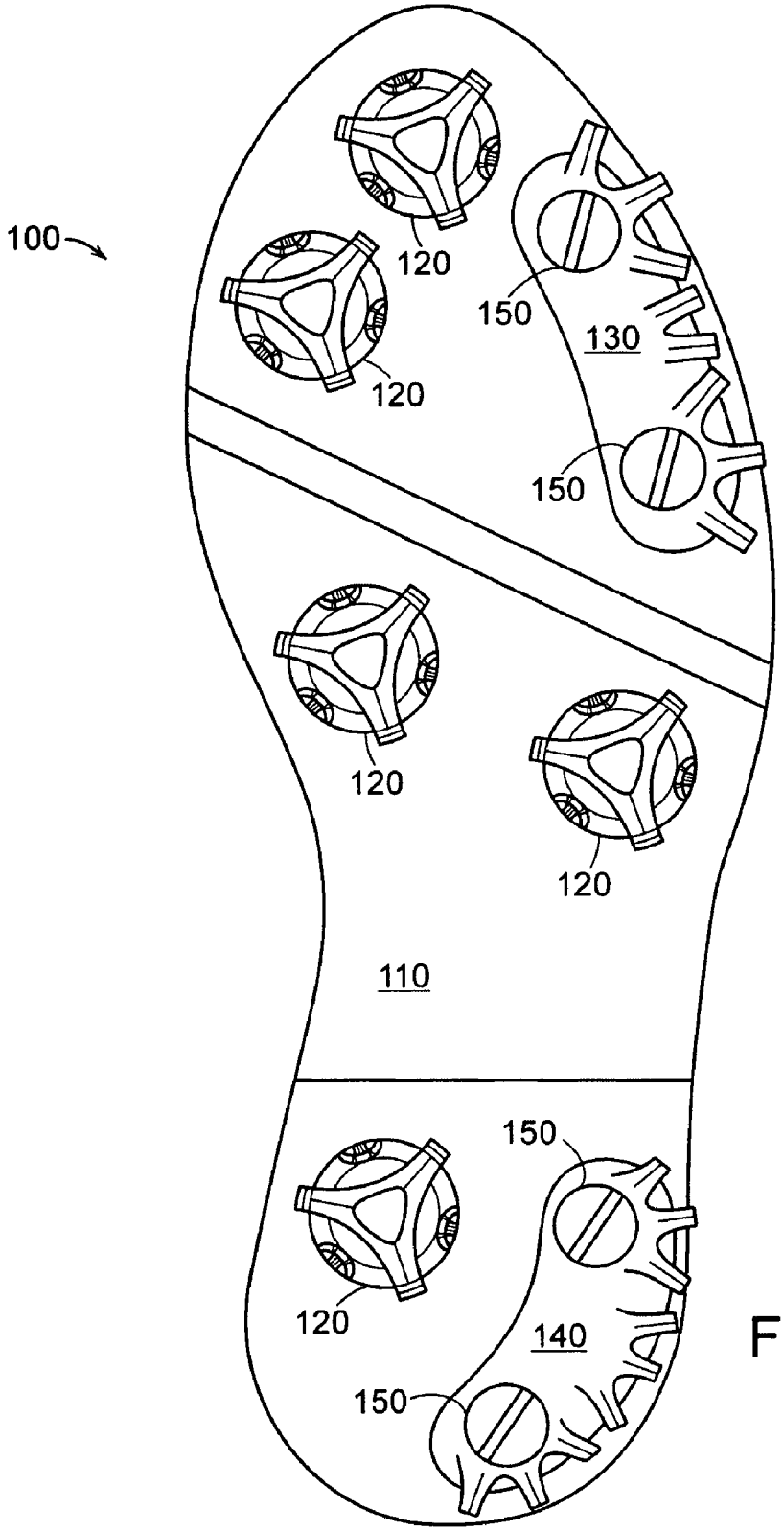
FIG. 1 shows a traction system for a shoe according to an embodiment of the invention.

FIG. 1 shows the bottom surface of a shoe, labeled generally 100, according to an embodiment of the invention. The shoe includes an outsole 110 in which a number of shoe-coupling element receptacles are embedded 120. Traction plates 130, 140 can be attached to the outsole by shoe-coupling elements 150 that are attached to the plates. The bottom portion of these elements are inserted into suitably placed receptacles embedded in the outsole 110 and rotated. Each plate includes one or more surface-engaging elements that provides traction for the user when one or more elements contacts a surface.

Figure 2A:
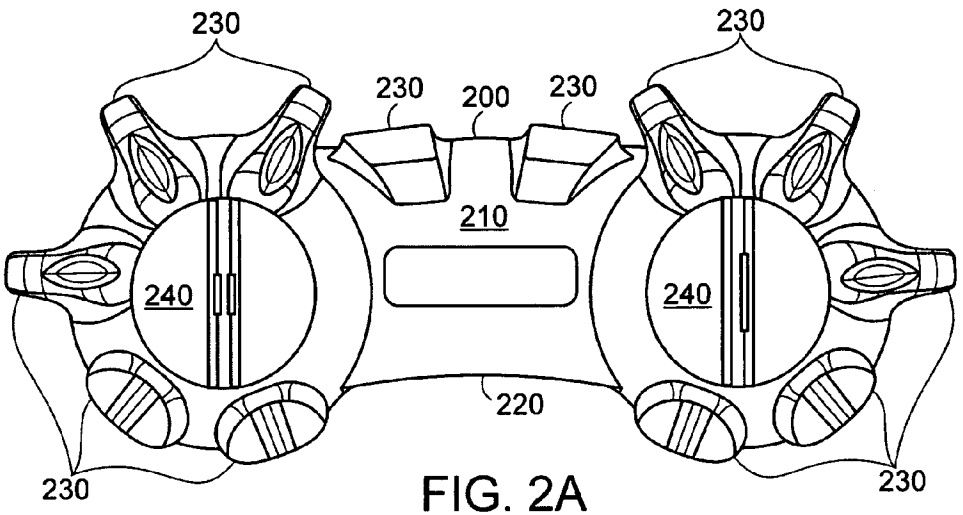
FIG. 2A shows a traction plate according to an embodiment of the invention.

FIG. 2A shows an embodiment of a traction plate 200, according to the present invention. The plate includes a flange with two opposing faces (one face is shown 210) and an edge 220. The face shown 210 includes surface-engaging elements 230 of various lengths, types and orientations. The top portion 240 of shoe-coupling elements is also shown. The shoe-coupling element tops include a slot for receiving a screwdriver blade (not shown). The screwdriver blade when rotated causes the shoe-coupling element to rotate. When the bottom portion (not shown) of the shoe-coupling element is inserted into a corresponding receptacle in the shoe outsole and the element is rotated, the shoe-coupling element secures the flange to the shoe outsole. A shoe-coupling element top can contain any suitable indentation pattern for receiving a tool, such as a Phillips head pattern or a Torx screw pattern and, alternatively, may contain a top structure that is suitable for human fingers to turn.

Figure 2B:
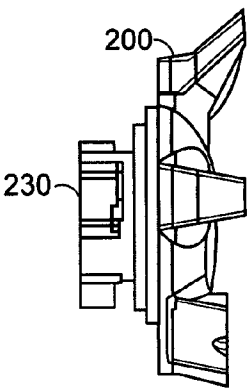
FIG. 2B shows a side view of the traction plate of FIG. 2A.
Figure 2C:
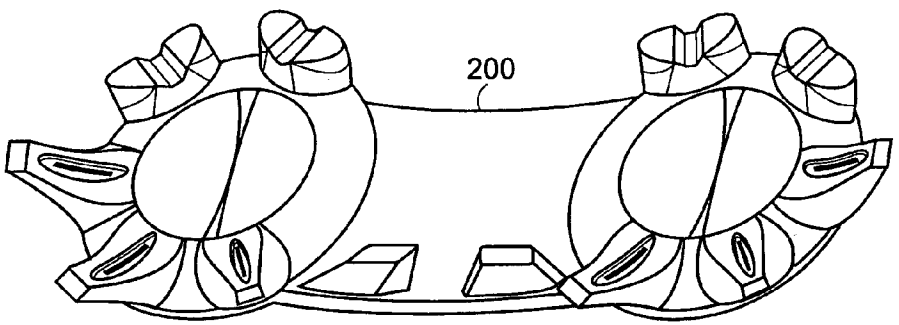
FIG. 2C shows a perspective view of the traction plate of FIG. 2A.

FIG. 2B is a side view of the traction plate 200 of FIG. 2A. A side view of the shoe attachment structure 250 of the shoe-coupling element is shown. The shoe-coupling element 240 may be captively attached to the flange of the traction plate. In alternative embodiments of the invention, a non-captive shoe-coupling element may be coupled to and uncoupled from the flange when the traction plate is affixed to the shoe. The shoe-coupling element head may be formed larger than the hole in the flange, for example. Thus, the element can securely capture the flange when the element is inserted through the flange into the receptacle and rotated. In further embodiments of the invention, a traction plate may include a mixture of both captively attached and non-captively attached shoe-coupling elements. The attachment structure of the shoe-coupling element may be of any shape that is suitable to mate with the corresponding receptacle in the shoe outsole. The attachment structure may conform to the Q-LOK™ system (as described in U.S. Pat. Nos. 5,768,809, 6,151,805, 6,108,944, and 6,463,618), to the Fast Twist™ system (as described in U.S. Pat. Nos. 5,123,184, 5,524,367, 5,974,700 and 6,272,774), to a threaded structure or to any other structure that may be rotatably attached to a receptacle. Each of the aforementioned patents are incorporated herein by reference. In a preferred embodiment of the invention, a shoe-coupling element attachment structure is employed that attaches to the receptacle, after insertion, with a rotation of no more than 360 degrees. In other embodiments, rotations of no more than 270 degrees, 180 degrees and 120 degrees respectively are required to attach each shoe-coupling element (and the traction plate to the outsole) to the shoe sole after insertion of the element into the receptacle. In other preferred embodiments of the inventions, different types of shoe-coupling elements may be employed on a single traction plate. In any of the variety of embodiments of the invention, traction plates attached to the same shoe outsole may be identical or may vary in number, type and placement of shoe-coupling elements and in number, type, placement and orientation of surface-engaging elements. Likewise, the material used for a traction plate flange, a shoe-coupling element or a surface-engaging element may be any material suitable for footwear cleats such as, without limitation, plastic, metal, rubber, etc. The various parts of a traction plate may also be made from more than one material or more than one species of a material and these parts may vary in color and hardness. FIG. 2C shows a perspective view of the traction plate.

Figure 3A:
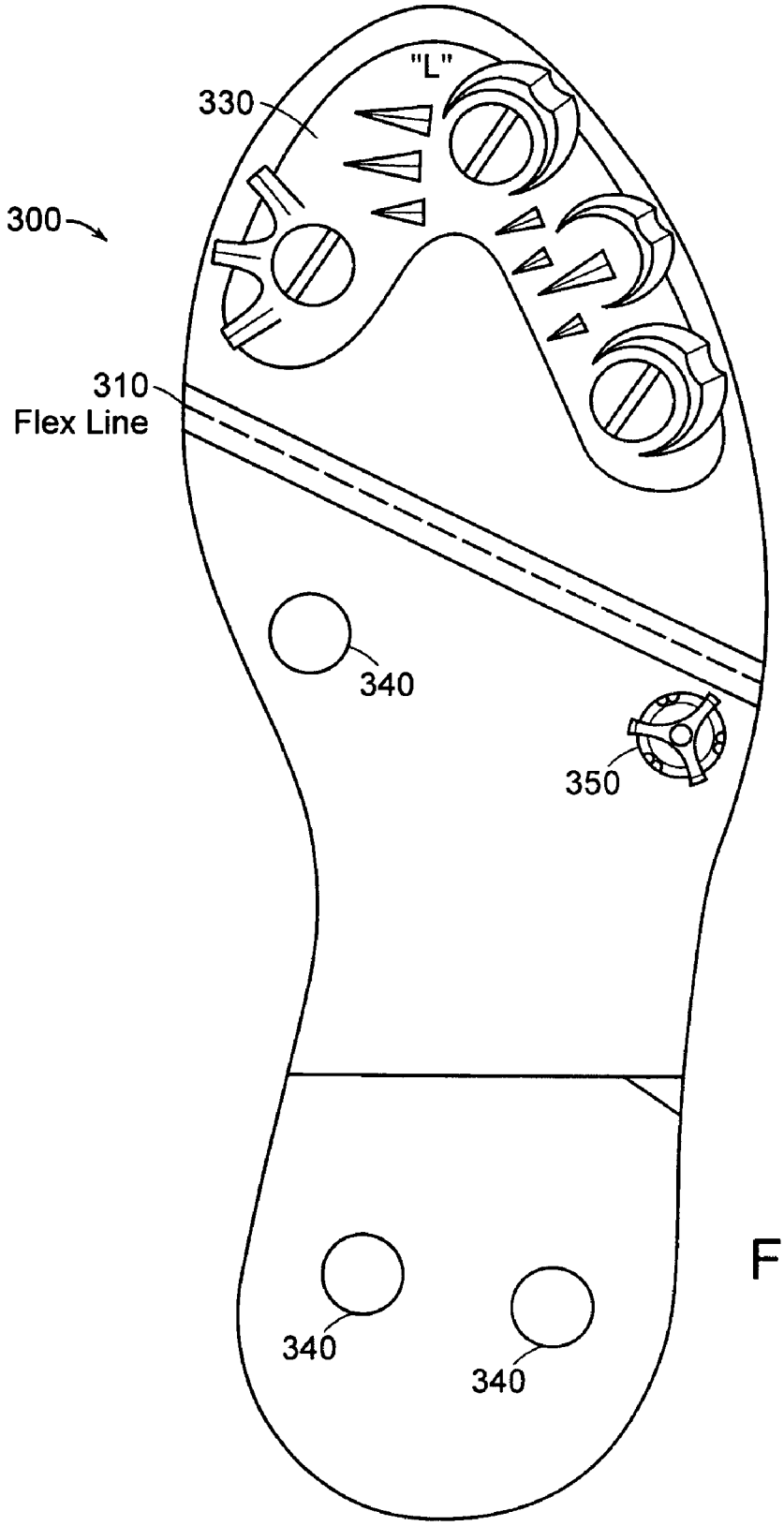
FIG. 3A shows an alternative traction system for a shoe according to an embodiment of the invention.
Figure 3B:
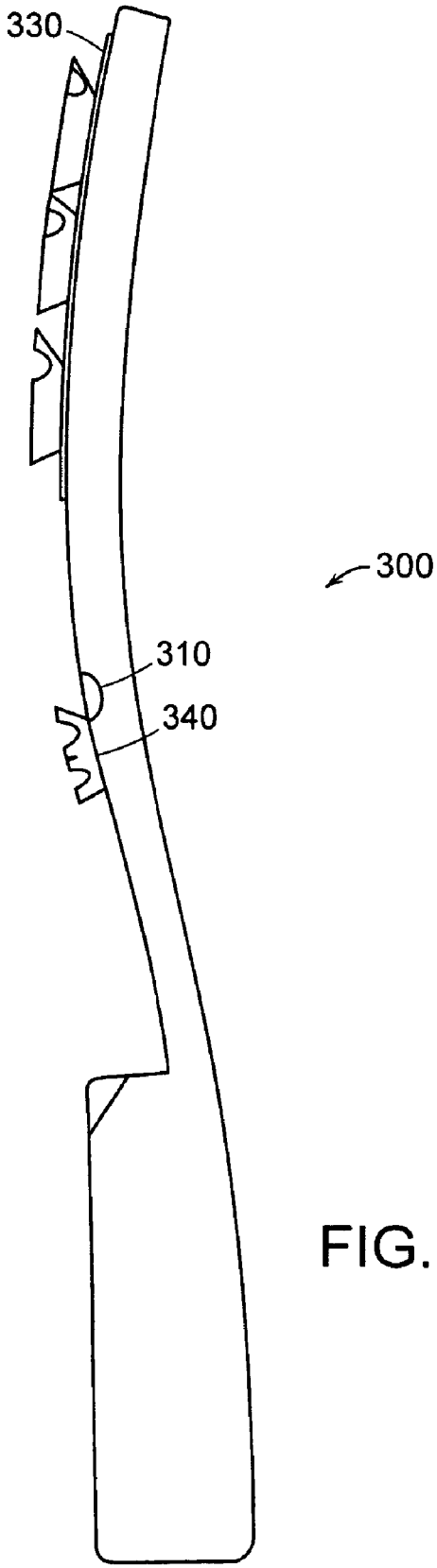
FIG. 3B shows a side view of the traction system shown in FIG. 3A.

FIG. 3 shows another preferred embodiment of the present invention. A shoe 300 includes a traction plate 330 that extends from one side of the shoe to the other, covering much of the toe area of the shoe. The shoe also includes receptacles 340 to which other traction devices such as conventional shoe cleats 350 may be attached. Also, shown is a flex-line 310 for the shoe. The shoe should be capable of flexing along the flex-line as the shoe wearer strides. The traction plate may be substantially rigid if the traction plate lies wholly on one side of the flex-line. Alternatively, the traction plate may be structured to straddle the flex-line. The traction plate may advantageously flex along the flex-line and may be rigid otherwise. In a variety of embodiments of the present invention, traction plates as described in any of the preceding embodiments may be used on the same shoe outsole with shoe cleats attached to cleat receptacles. FIG. 3B shows a side view of the embodiment of the invention pictured in FIG. 3A.

Figure 4B:
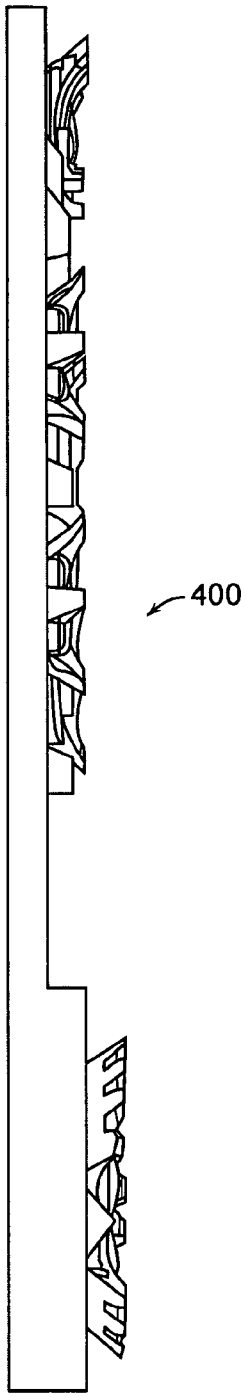
FIG. 4B shows a side view of the traction system shown in FIG. 4A.
Figure 4A:
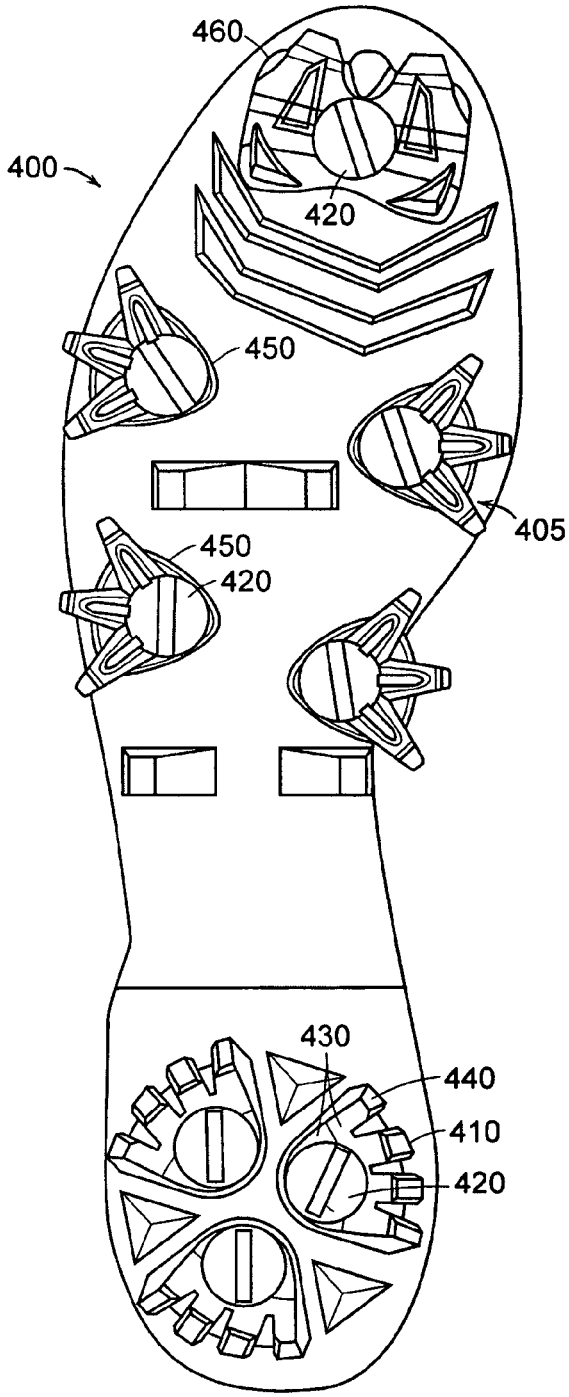
FIG. 4A shows a further traction system for a shoe according to an embodiment of the invention.

FIG. 4 shows a traction system for a shoe 400 according to a further embodiment of the present invention. The shoe includes an outsole 405 with a variety of removably attached traction plates 410, 450, 460. Each traction plate includes a single shoe-coupling element 420 removably attached to the traction plate flange 430. The flange 430 also includes at least one surface-engaging element 440. The traction plate may be directional, as shown, or unidirectional. To attach a traction plate 410, 450, 460 to the shoe, a shoe-coupling element 420 can be inserted through an opening in the flange into a corresponding receptacle (not shown) in the outsole. The shoe-coupling element is shaped to capture the traction plate flange. The traction plate 410 is positioned on the shoe outsole in the proper orientation and the shoe-coupled element 420 is then rotated to secure the plate to the shoe. This attachment procedure can advantageously ensure that a desired orientation for the traction plate in relation to the shoe outsole is achieved, since the shoe-coupling element and the flange may rotate with respect to each other.

Figure 5A:
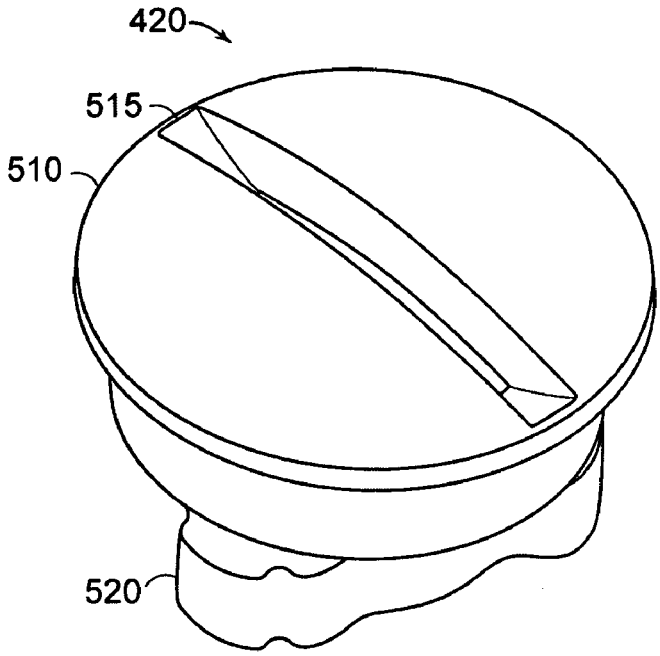
FIGS. 5A and 5B show a shoe-coupling element that may be employed in the traction system of FIGS. 4A and 4B.
Figure 5B:
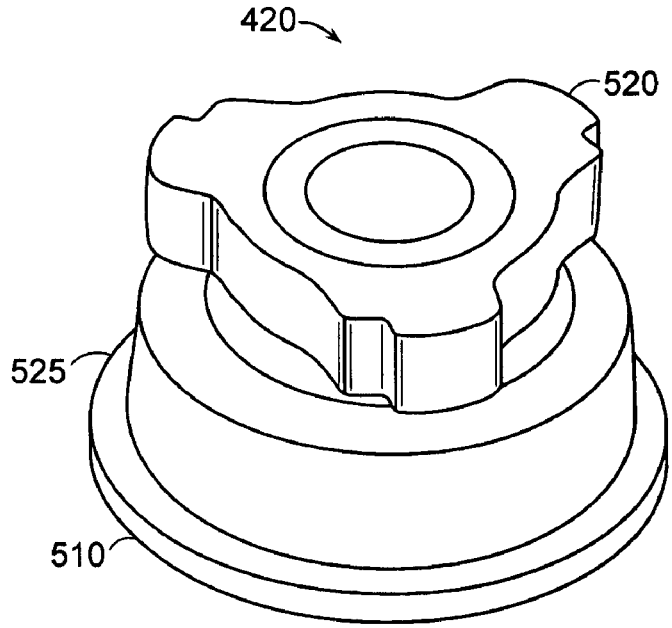

FIGS. 5A and 5B show a shoe-coupling element 420 that can be employed in the embodiment of the inventions shown in FIG. 4 and in FIG. 1. The shoe-coupling element has a head 510 at one end. The head includes a slot 515 to receive a slotted tool such as a screwdriver. The tool can then be rotated to attach the element to the corresponding shoe receptacle. The element head 510 has a diameter 525 that is larger than the hole in the corresponding flange, thus allowing the coupling element 500 to capture the flange after the element is inserted through the hole. The end of the shoe-coupling element 520, which is distal to the head 510, includes a receptacle-coupling-structure 520. The receptacle-coupling structure 520 can attach to a corresponding receptacle in the shoe after insertion and a rotation of less than 360 degrees. In other embodiments of the invention, the head of a shoe-coupling element can include any indentation pattern suitable for receiving a tool or may include a structure suited for rotation by hand. Other types of shoe-coupling elements may be employed that attach to a shoe receptacle after insertion and rotation of no more than 270 degrees, 180 degrees or 120 degrees respectively.

In a further embodiment of the invention, a method is provided for replacing cleats on a shoe with a traction plate. A traction plate is provided with a plurality of shoe-coupling elements. The cleats are removed from the set of receptacles embedded in the outsole of the shoe that will be covered by the plate. The shoe-coupling elements are inserted into the receptacles and then rotated to attach the traction plate to the shoe. In analogous fashion, the traction plate may be removed from the shoe by rotating the shoe-coupling elements in the reverse direction and removing the elements from the receptacles. The cleats can then be reinstalled in the shoe, if desired, or other traction plates may be installed.

In another embodiment of the invention, a wear indicator may be incorporated into the traction bar on the surface engaging side of the flange for any of the above described embodiments of the invention. The wear indicator may be, for example, constructed similarly to the wear indicator described in U.S. Pat. No. 5,996,260, which is incorporated herein by reference.

While preferred embodiments have been described in which a traction plate can be removably attached to a shoe using the described connectors and receptacles, the use of such connectors and receptacles is not limited to attaching traction plates to shoes, but may be generally employed as a removably attachable connector system in other applications which require the attachment of one mechanical structure to another. Similarly, it is of course apparent that the present invention is not limited to the detailed description set forth above. Various changes and modifications of this invention as described will be apparent to those skilled in the art without departing from the spirit and scope of this invention as defined in the appended claims.

What is claimed is:

1. A shoe outsole assembly, comprising:

a. an outsole;

b. a receptacle embedded in the outsole, the receptacle having an opening and a shoe-coupling element engaging structure;

c. a traction plate, the plate including:

i. a flange including opposing first and second faces, ii a shoe-coupling element captively attached to the flange such that the flange captively retains the at least one shoe-coupling element when the shoe-coupling element is detached from the shoe and the flange is rotated about any axis, the shoe-coupling element removably attachable to the receptacle, the shoe-coupling element capable of attachment to the shoe and detachment from the shoe by insertion into the receptacle and rotation of less than 360 degrees, and iii at least one surface-engaging element attached to the second face.

2. A shoe outsole assembly, comprising:

a. an outsole;

b. a plurality of receptacles embedded in the outsole, each receptacle having an opening and a shoe-coupling element engaging structure;

c. a traction plate, the plate including:

i a flange including opposing first and second faces, ii a plurality of shoe-coupling elements attached to the flange, each shoe-coupling element removably attachable to one of the plurality of receptacles, at least one shoe-coupling element captively attached to the flange such that the flange captively retains the at least one shoe-coupling element when the shoe-coupling element is detached from the shoe and the flange is rotated about any axis, and iii at least one surface-engaging element attached to the second face.

3. A shoe outsole assembly according to any of claims 1 and 2, wherein the flange of the traction plate is substantially flush with the outsole.

4. A shoe outsole assembly according to either of claims 1 and 2, wherein the traction plate is attached to the midsole area of the shoe outsole.

5. A shoe outsole assembly according to either of claims 1 and 2, wherein the flange of the plate is at least partially inset into the outsole of the shoe.

6. A shoe outsole assembly according to either of claims 1 and 2, further including at least one cleat, the cleat including a shoe-coupling element at least one surface-engaging element, the cleat removably attached to the outsole.

7. A shoe outsole assembly according to either of claims 1 and 2, further including:

d. at least one surface-engaging element non-removably attached to the outsole.

8. A shoe outsole assembly according to either of claims 1 and 2, wherein the traction plate is attached to the toe area of the shoe outsole.

9. A shoe outsole assembly according to either of claims 1 and 2, wherein the traction plate is attached to the heel area of the shoe outsole.

* * * * *

UNITED STATES PATENT AND TRADEMARK OFFICE

CERTIFICATE OF CORRECTION

PATENT NO. : 7,654,013 B2
APPLICATION NO. : 11/179034
DATED : February 2, 2010
INVENTOR(S) : Armand J. Savoie et al.

It is certified that error appears in the above-identified patent and that said Letters Patent is hereby corrected as shown below:

In Column 6, Line 44
replace "at least one surface-engaging element,"
with "and at least one surface-engaging element,"

Signed and Sealed this

Fifteenth Day of June, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,654,013 B2
APPLICATION NO. : 11/179034
DATED : February 2, 2010
INVENTOR(S) : Savoie et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 865 days.

Signed and Sealed this

Twenty-third Day of November, 2010

David J. Kappos

David J. Kappos
*Director of the United States Patent and Trademark Office*